US005582303A

United States Patent [19]

Sloan

[11] Patent Number: 5,582,303

[45] Date of Patent: Dec. 10, 1996

[54] CLOTHES ROD SUPPORT BRACKET

[76] Inventor: Stewart E. Sloan, 12624 Izard St., Omaha, Nebr. 68154

[21] Appl. No.: 367,592

[22] Filed: Jan. 3, 1995

[51] Int. Cl.[6] ..... A47F 7/00

[52] U.S. Cl. ..... 211/105.1

[58] Field of Search ..... 211/90, 123, 105.1; 248/251

[56] References Cited

U.S. PATENT DOCUMENTS

| | | | |
|---|---|---|---|
| D. 244,006 | 4/1977 | Vanderly | D8/366 |
| 2,886,278 | 5/1959 | Opie | 248/274 |
| 2,903,223 | 9/1959 | De Gray | 248/221 |
| 2,908,471 | 10/1959 | Hollansworth | 248/247 |
| 2,940,600 | 6/1960 | Bonia et al. | 211/90 |
| 3,034,758 | 5/1962 | Vagi | 248/251 |
| 3,113,678 | 12/1963 | Dickinson et al. | 211/90 |
| 3,120,309 | 2/1964 | Goettl et al. | 211/123 |
| 3,239,070 | 3/1966 | Clauson | 211/105.1 |
| 3,282,548 | 11/1966 | Ruhnke | 248/243 |
| 3,286,850 | 11/1966 | Ruhnke | 211/105.1 |
| 3,664,511 | 5/1972 | Fenwick | 211/105.1 |
| 3,669,395 | 6/1972 | Gehrke | 248/235 |
| 3,685,662 | 8/1972 | Varon et al. | 211/105.1 |
| 4,671,419 | 6/1987 | Beverly | 211/105.1 |

*Primary Examiner*—Alvin C. Chin-Shue
*Assistant Examiner*—Sarah L. Purol
*Attorney, Agent, or Firm*—Zarley, McKee, Thomte, Voorhees & Sease; Dennis L. Thomte

[57] ABSTRACT

A clothes rod support bracket including a metal strap having two bends therein to form a vertical back portion, a horizontal shelf supporting portion, and a depending front portion. A hook portion depends and projects forwardly from the front portion and has an arcuate lip projecting forwardly from the forward end thereof. The lip is oriented generally horizontally to support a clothes rod thereon. A second embodiment of the invention omits the back portion and cross-brace and has openings in the horizontal portion for fastening the horizontal portion to a shelf.

2 Claims, 2 Drawing Sheets

CLOTHES ROD SUPPORT BRACKET

TECHNICAL FIELD OF THE INVENTION

This invention relates generally to clothes rod support brackets, and more particularly to support brackets which include portions for supporting both a clothes rod and a shelf.

BACKGROUND OF THE INVENTION

Rods for hanging clothes in closets have been utilized for many, many years, and typically are supported on each end by various brackets attached to the side walls of the closet. It is also conventional to utilize some type of intermediate brackets between the side walls in order to provide additional support for the clothes rod. However, it has long been a problem to provide an intermediate support bracket which does not interfere with the sliding of hangers on the clothes rod. There have been a variety of patents for hang rod assemblies which attempt to solve this problem by providing a specially designed rail which is mounted on the projecting ends of various brackets. The major drawback of such devices is the fact that a conventional, economical clothes rod cannot be used in combination with such brackets. Rather, the clothes rod in those inventions must be specially designed for the specific bracket upon which it is used. Thus, there is no possible interchangeability of clothes rods for conventional brackets on the market today.

The clothes rod support brackets which overcome the problem of interference with sliding hangers on the clothes rod suffer yet another problem. They will not provide support for a shelf above the clothes rod. Because many items placed on closet shelves extend beyond the shelf, a shelf must be positioned above the clothes rod so that overhanging items do not interfere with the hangers or clothes.

It is therefore a general object of the present invention to provide an improved clothes rod support bracket.

Yet another object is to provide a bracket which will support a conventional cylindrical clothes rod.

A further object of the present invention is to provide a bracket which will support a clothes rod in a manner such that the bracket does not interfere with hangers sliding along the rod.

Yet another object is to provide an intermediate clothes rod support bracket which will also support a shelf at a height above the clothes rod.

These and other objects will be apparent to those skilled in the art.

SUMMARY OF THE INVENTION

The clothes rod support bracket of this invention includes a metal strap having two bends therein to form a vertical back portion, a horizontal shelf-supporting portion, and a depending front portion. A cross-brace is connected between the back portion and the front portion for additional strength. A hook portion depends and projects forwardly from the front portion and has an arcuate lip projecting forwardly therefrom. The lip is oriented generally horizontally to support a clothes rod thereon. Hangers on the clothes rod will slide freely along the rod, with the free end of the hook of the hanger depending freely into the hook portion of the bracket.

A second embodiment of the invention omits the back portion and cross-brace and has openings in the horizontal portion for fastening the horizontal portion to a shelf. Thus, in locations where the wall will not provide support, the bracket may be attached to a shelf to support the clothes rod.

PREFERRED EMBODIMENT OF THE INVENTION

Figure 5:
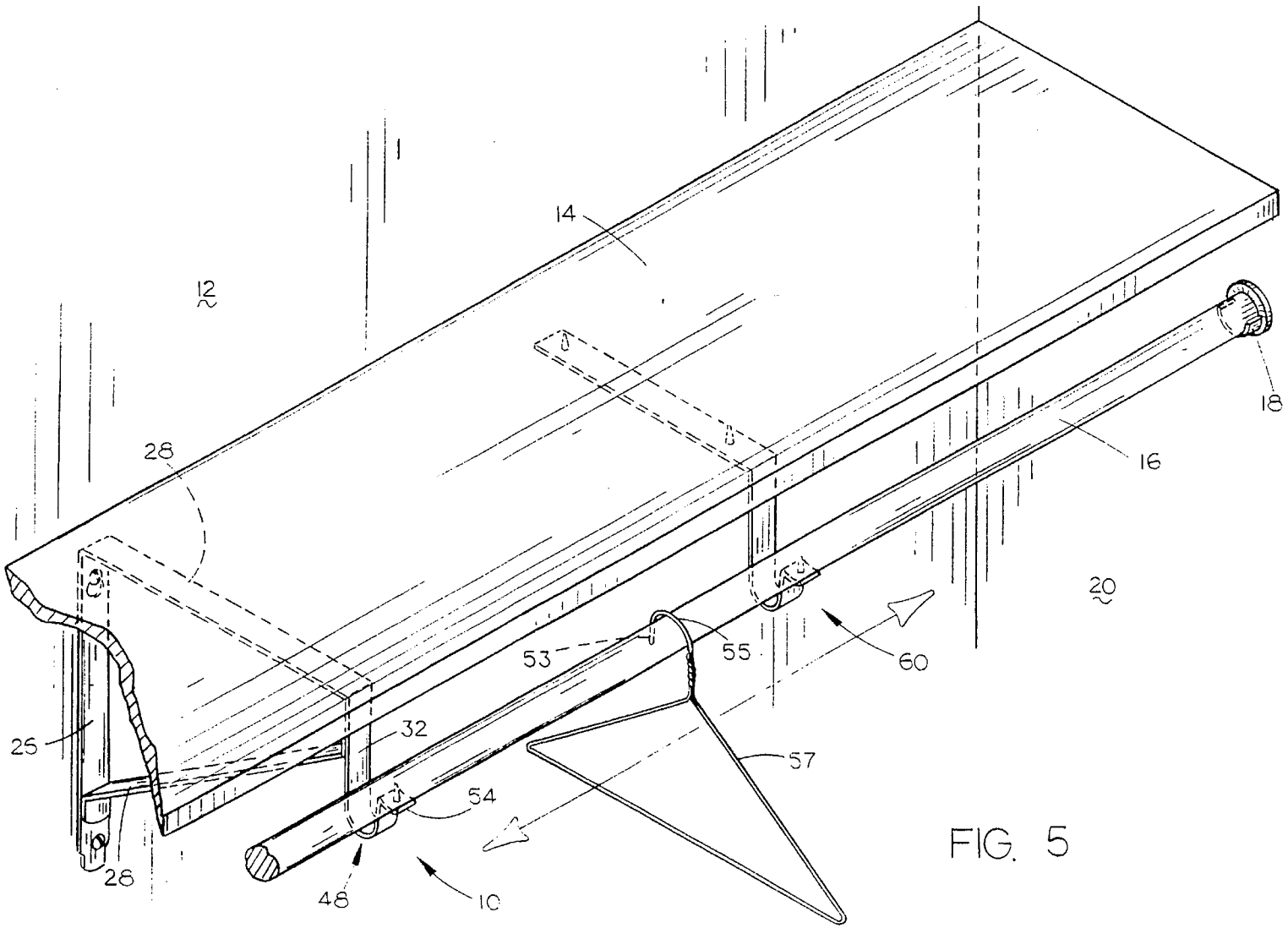
FIG. 5 is a perspective view of two embodiments of the present invention as utilized in a conventional closet.

Referring now to the drawings, in which similar or corresponding parts are identified by the same reference numeral, the combination clothes rod and shelf support bracket of this invention is designated generally at 10 and is fastened to a vertical wall 12 to support a shelf 14 and a conventional clothes rod 16, as shown in FIG. 5.

FIG. 5 is a perspective view of the interior of a conventional closet and shows clothes rod 16 supported at one end by a conventional cup-shaped wall bracket 18 which is fastened to a vertical side wall 20. A similar cup-shaped wall bracket is affixed to the opposite wall (not shown) so as to support both ends of clothes rod 16. In order to prevent the clothes rod from sagging or otherwise deforming, intermediate supporting brackets are utilized.

FIG. 5 shows two embodiments of the present invention, the first embodiment designated as bracket 10, and the second embodiment designated as bracket 60 (to be described in more detail hereinbelow). It is noted that in situations where the side walls 20 of a closet are not utilized to support clothes rod 16, additional brackets 10 could be fastened to the back wall 12 at each end of the clothes rod 16 for support of the ends.

Figure 1:
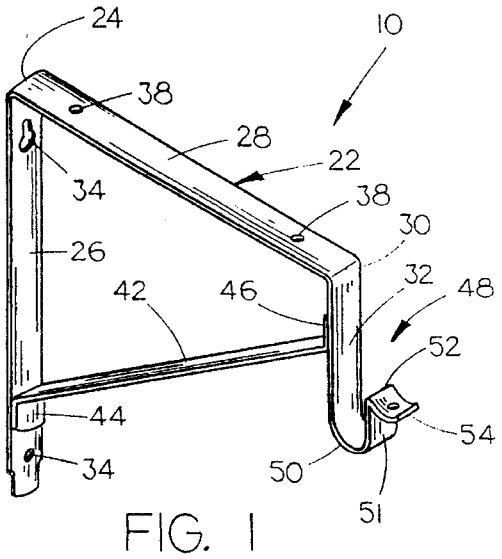
FIG. 1 is a perspective view of a first embodiment of the present invention.
Figure 2:
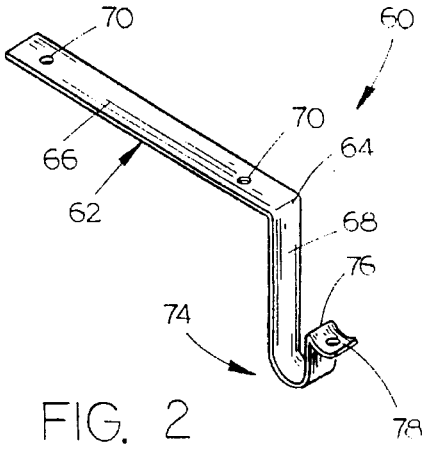
FIG. 2 is a perspective view of a second embodiment of the present invention.
Figure 3:
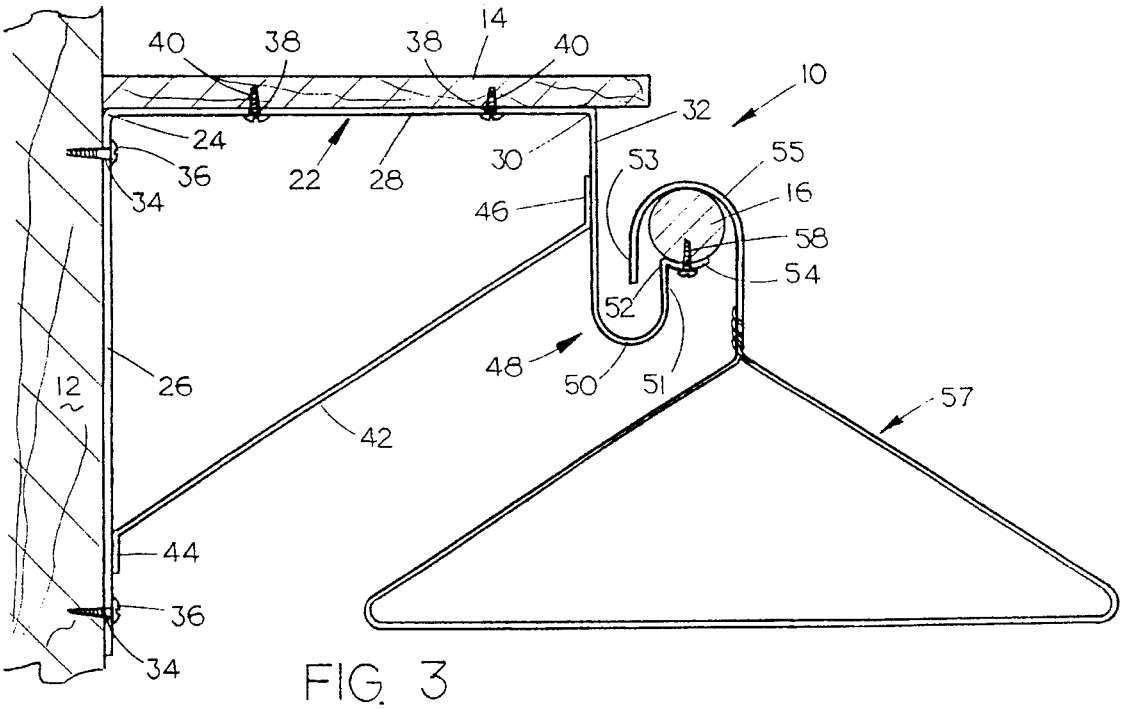
FIG. 3 is a side elevational view of the embodiment of the present invention shown in FIG. 1.

Referring now to FIGS. 1, 3 and 5, bracket 10 of this invention is formed from two separate elements fastened together into a single integral unit. One element is a metal strap designated generally at 22, having a first right angle bend 24, forming a vertical back member 26 and a horizontal member 28. A second right angle bend 30, at the opposite end of horizontal member 28, forms a short vertical front member 32 generally parallel to back member 26. Back member 26 is provided with at least two apertures 34, one adjacent the upper end and one adjacent the lower end, through which screws 36 are fastened into back wall 12 of the closet. Horizontal member 28 of bracket 10 is also provided with apertures 38 through which screws 40 may be fastened into shelf 14.

The second element of bracket 10 is a metal cross-brace 42, preferably of the same strap material as strap 22. Cross-brace 42 is inclined and fastened by welding or the like at its lower end 44 to the lower end of back member 26, and at its upper end 46 to front portion 32 of bracket 10. Front portion 32 extends downwardly and thence forwardly to form a hook portion 48, having an arcuate bottom 50 and a generally vertical forward end 51.

The forward end 51 of hook portion 48 is bent at 52 to form a generally horizontally-oriented arcuate lip 54. Arcuate lip 54 subscribes an arc having a radius substantially equal to the radius of clothes rod 16, so that the lower portion of clothes rod 16 will fit against the arcuate portion of lip 54, as shown in FIG. 3. It is preferred that the width of lip 54 be less than the diameter of clothes rod 16 such that vertical tangents to the periphery of clothes rod 16 will not intersect any portion of lip 54. In this way, depending end 53 of the hook 55 of a hanger 57 will extend downwardly towards the bottom 50 of hook portion 48, and will not interfere with any portion of bracket 10.

Lip 54 of bracket 10 has an aperture through which a screw 58 may be fastened directly into the clothes rod 16. It can be seen that clothes rod 16 may be a conventional wood, cylindrical clothes rod, and does not require any special shape. Front portion 32 of bracket 10 is of a length great enough to locate clothes rod 16 below shelf 14. Hook portion 48, lip 54, and front member 32 are designed to have dimensions such that bracket 10 may replace any conventional shelf and clothes rod bracket (which would interfere with hangers sliding therealong). Replacing the conventional brackets in a closet allows hangers to be slid along the clothes rod 16 without interference yet does not require changing the height of the rod, nor any other modifications to the existing shelf or walls.

Figure 4:
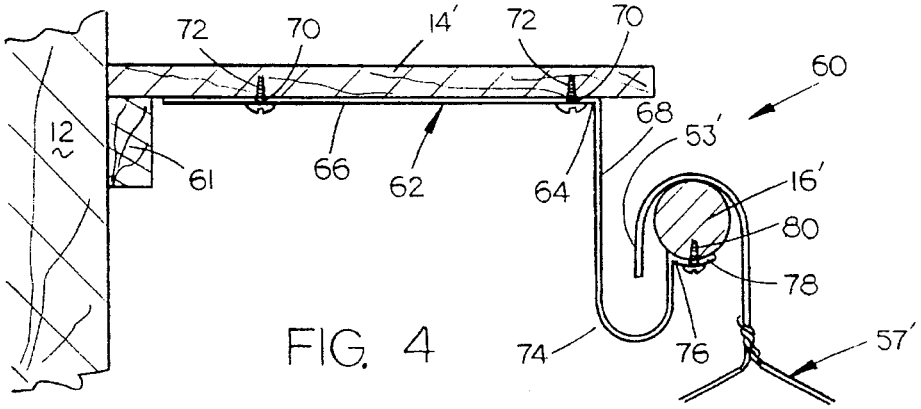
FIG. 4 is a side elevational view of the embodiment of the present invention shown in FIG. 2

Referring now to FIG. 4, the second embodiment of the invention is designated generally at 60 and is designed for use in situations where bracket 10 may not be adequately fastened to back wall 12'. In such situations, shelf 14' is typically supported at its rearward edge by a horizontally extending support member 61 fastened to wall 12', in a conventional manner. Thus, shelf 14' is sufficiently rigid to assist in supporting clothes rod 16'.

The second embodiment of the invention, designated generally at 60, is formed from a single metal strap 62 having a right angle bend 64 therein, forming a horizontal member 66 and a vertical forward member 68. Horizontal member 66 has a pair of apertures 70 therein through which fasteners 72 may be fastened to shelf 14'. Vertical forward member 68 is oriented adjacent the forward edge of shelf 14' and extends downwardly and curves forwardly and up to form a hook portion 74, similar to the hook portion 48 of the first embodiment. Hook portion 74 extends upward generally vertical and parallel to vertical member 68 and is bent at 76 to form a horizontally-oriented projecting arcuate lip 78, similar to arcuate lip 54 of the first embodiment. A fastener 80 may be inserted through an aperture in arcuate lip 78 to fasten clothes rod 16' to arcuate lip 78.

Thus, it can be seen that clothes rod 16' may be supported intermediate its ends by bracket 60 fastened to shelf 14'. The intermediate support bracket 60 will not interfere with hangers which are supported on clothes rod 16', because the depending end 53' of a hanger 57' will extend freely into hook portion 74 of bracket 60.

It can therefore be seen that the invention fulfills at least all of the above stated objectives.

I claim:

1. A clothes rod support bracket for supporting an elongated, horizontally disposed clothes rod thereon having at least one clothes hanger slidably mounted thereon, said clothes hanger having a supporting hook at its upper end which extends over said clothes rod and which has a depending hook end positioned below said clothes rod, comprising:

a rigid strap member having a horizontally disposed portion, with inner and outer ends, and a generally vertically disposed forward portion extending downwardly from the outer end of said horizontally disposed portion, said forward portion having upper and lower ends;

a hook portion at the lower end of said forward portion and extending downwardly, forwardly, and thence upwardly therefrom;

and a clothes rod supporting lip portion projecting generally horizontally from the upper end of the upwardly extending portion of said hook portion;

said lip portion of said bracket being spaced outwardly of said vertically disposed portion a distance sufficient to receive the said hook end of said hanger mounted on the clothes rod;

said lip portion of said bracket being adapted to receive and support said clothes rod thereon such that the clothes hanger hung on said clothes rod on said lip portion will have its said depending hook end hanging downwardly between said vertically disposed portion and said horizontally disposed portion and freely slidable along the clothes rod.

2. The combination of claim 1 wherein said lip portion of said bracket is arcuate so as to correspond to the curvature of the clothes rod mounted thereon.

* * * * *